United States Patent [19]

Markus

[11] Patent Number: 4,504,213

[45] Date of Patent: Mar. 12, 1985

[54] FUEL INLET ASSEMBLIES FOR FUEL REACTORS

[75] Inventor: Gerardus A. Markus, S/Gravenzande, Netherlands

[73] Assignee: BS&B Engineering Company Inc., Houston, Tex.

[21] Appl. No.: 631,525

[22] Filed: Jul. 18, 1984

Related U.S. Application Data

[63] Continuation of Ser. No. 524,110, Aug. 14, 1983, abandoned, which is a continuation of Ser. No. 257,205, Apr. 24, 1981, abandoned.

[30] Foreign Application Priority Data

Jun. 27, 1980 [GB] United Kingdom ..... 8019827

[51] Int. Cl.[3] ..... F23D 13/40

[52] U.S. Cl. ..... 431/116; 431/158; 431/346; 431/350; 431/354; 60/760; 239/419.5

[58] Field of Search ..... 431/114, 116, 158, 183, 431/284, 346, 351-355; 432/222; 60/760; 239/419.5, 425.5; 48/180 C

[56] References Cited

U.S. PATENT DOCUMENTS

| | | | |
|---|---|---|---|
| 1,515,172 | 11/1924 | Ronstrom | 239/419.5 |
| 1,976,870 | 10/1934 | Weber | 431/351 |
| 2,727,566 | 12/1955 | Bonvillian et al. | 431/351 |
| 3,414,362 | 12/1968 | Schoppe | 431/353 |
| 3,485,566 | 12/1969 | Schoppe | 431/158 |
| 3,720,497 | 3/1973 | Arenson | 431/158 |

FOREIGN PATENT DOCUMENTS

| | | | |
|---|---|---|---|
| 2193141 | 2/1974 | France . | |
| 39653 | 1/1907 | Switzerland | 60/760 |
| 265402 | 2/1927 | United Kingdom . | |
| 741440 | 12/1955 | United Kingdom . | |
| 860057 | 2/1961 | United Kingdom . | |
| 863258 | 3/1961 | United Kingdom . | |
| 1026263 | 4/1966 | United Kingdom . | |
| 1294410 | 10/1972 | United Kingdom . | |
| 1299696 | 12/1972 | United Kingdom . | |

*Primary Examiner*—Randall L. Green

*Attorney, Agent, or Firm*—Delmar L. Sroufe

[57] ABSTRACT

A fuel inlet assembly for a fuel reactor which has an inner shell mounted coaxially within an outer shell, which is closed at one axial end, the outer shell having an inlet for introducing combustion air into the annular space between the inner and outer shells, the other end of the inner shell being spaced from the inlet assembly which is mounted at the other end of the outer shell, the fuel inlet assembly including a base plate which is mountable on said other end of the outer shell, and having a fuel inlet aperture therein. A first frusto-conical inlet cone is mounted on the base plate to surround the fuel inlet aperture and a second frusto-conical inlet cone is mounted coaxially therewith by means of a plurality of circumferentially spaced vanes which extend in radial planes, the second cone overlapping the first cone, whereby a portion of the combustion air can flow through the annular space between the first and second inlet cones, with an axial component of velocity, to premix with the fuel entering at the first fuel inlet aperture.

6 Claims, 6 Drawing Figures

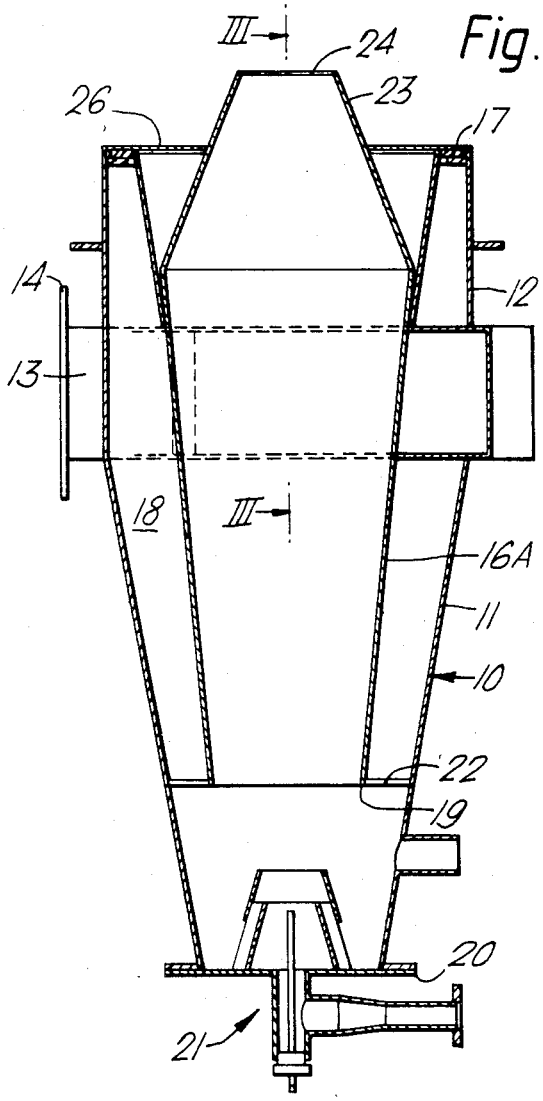
Fig. 1.
Fig. 4.
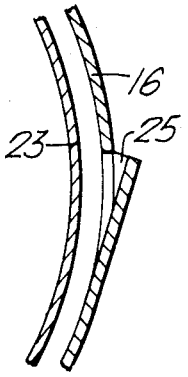

FUEL INLET ASSEMBLIES FOR FUEL REACTORS

This application is a continuation of application Ser. No. 06/524,110, filed Aug. 14, 1983, which was a continuation of Application Ser. No. 06/257,205 filed Apr. 24, 1981, both abandoned.

DESCRIPTION

The present invention relates to fuel inlet assemblies for fuel reactors.

One particular form of fuel reactor, or high intensity burner, has been proposed which includes an outer shell which is of generally circular cross-section, and usually frusto-conical, with a fuel inlet being provided at one end, usually the lower end, so that fuel is projected axially into the shell. An inner shell is mounted within the outer shell, with its lower end spaced from the inner end of the outer shell, its peripheral walls spaced from the wall of the outer shell to provide an annular space into which combustion air is forced by way of a tangential combustion air inlet.

The combustion air swirls downwardly and combines with the fuel and is ignited, and the products of combustion are discharged through a discharge nozzle at the upper end of the inner shell.

Whilst such reactors or burners are generally satisfactory, there are certain problems involved in the level of noise and the stability of the flame, and in particular of the pilot flame, if this is provided.

It is now proposed, according to the present invention, to provide a fuel inlet assembly for a fuel reactor which has an inner shell mounted coaxially within an outer shell, which is closed at one axial end, the outer shell having an inlet for introducing combustion air into the annular space between the inner and outer shells, the other end of the inner shell being spaced from the inlet assembly which is mounted at the other end of the outer shell, said fuel inlet assembly comprising a base plate mountable to close said other end of the outer shell, a fuel inlet aperture in said base plate, a first frusto-conical inlet come mounted on said base plate to surround said fuel inlet aperture and with the wider end of the cone adjacent to the base plate and a second frusto-conical inlet cone mounted coaxially with and spaced from the first cone, the wider end of the second cone facing the base plate and being spaced therefrom, whereby a portion of the combustion air can flow from the outer shell through the conduit provided by annular space between said first and second inlet cones, to premix with fuel entering at said first inlet aperture, whereby the remainder of the combustion air mixes with the fuel on the side of the second cone remote from the base plate.

With such a construction, a very thorough mixing of the combustion air with the fuel can be achieved, and the noise generated by the reactor under normal operating conditions can be very low as compared with conventional reactors, in this instance being below 80 dB. It has been found that the arrangement also ensures that the flame is held at the base of the inner shell, which gives good combustion characteristics.

A particularly stable arrangement can be provided when the second inlet cone is mounted on the first inlet cone by means of a plurality of circumferentially spaced vanes or legs, which preferably extend in radial planes with respect to the axis of the cones. The second inlet cone preferably overlaps the first inlet cone, so that the portion of the combustion air has an axial component of velocity as it passes through the annular space to enter the second inlet cone.

A pilot burner may be extended axially through the inlet aperture to a location within the first inlet cone and it has been found that the pilot flame in such an arrangement is very stable for the full range of combustion air flows.

Preferably the first cone includes at least one flame arrestor screen and a spark igniter and/or a flame detector, for example an ultraviolet flame detector may be provided within the first cone.

In order that the present invention may more readily be understood, the following description is given, merely by way of example, with reference being made to the accompanying drawings, in which:

FIG. 1 is a longitudinal section through one embodiment of fuel reactor with a fuel inlet assembly according to the invention mounted therein;

FIG. 4 is an enlarged scrap section taken along line IV—IV of FIG. 3.

Figure 2:
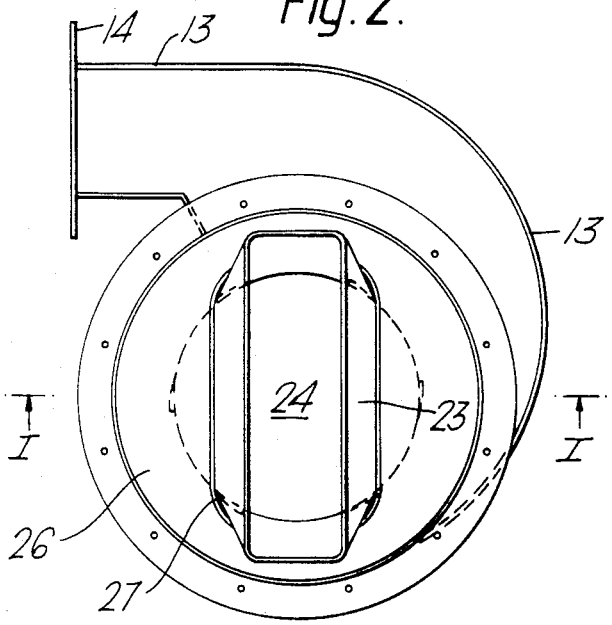
FIG. 2 is a top plan view of the reactor of FIG. 1.

Referring first to FIGS. 1 and 2, there is indicated a fuel reactor comprising an outer circular cross-section shell indicated by the reference numeral 10 having a frusto-conical lower portion 11 surmounted by a cylindrical portion 12. A tangentially arranged combustion air inlet 13 is connected to the lower part of the cylindrical portion 12 and terminates in a fixing flange 14 for securing to a suitable blower discharge. At its upper end the outer shell cylindrical portion 12 has a radially inwardly directed support ring 15 welded thereto. An inner wall 16, of generally frusto-conical upwardly divergent form has a radially outwardly extending flange 17 which rests on and is supported by the ring 15 of the outer shell. A tapered, upwardly diverging inner shell 16A is mounted in and extends below the inner wall 16, the ring 15 and flange 17 together closing the annular space 18 formed between the outer shell 11, outer cylindrical portion 12, and inner wall 16 and inner shell 16A.

At its lower end 19 the shell is spaced axially from a base plate 20 which is secured to the lower end of the outer shell 11. A fuel inlet assembly is indicated by the general reference numeral 21 and will be described in more detail later. Suffice it to say, for the present, the fuel inlet assembly 21 projects fuel, usually gaseous fuel, into the inner shell 16A along the axis thereof. A spider 22 maintains the lower end 19 of the inner shell 16 away from the wall of the outer shell 11, and permits combustion air, which is blown in through the tangential combustion air inlet 13, to swirl downwardly and act as the combustion air for the fuel.

Figure 3:
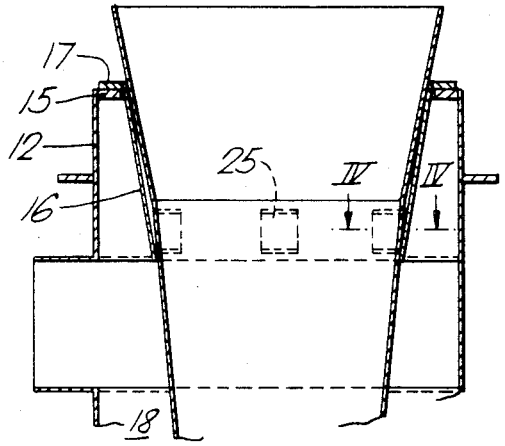
FIG. 3 is a section taken along line III—III of FIG. 1.

At its upper end, the inner shell 16 is provided with a fishmouth discharge nozzle 23 which may be made of ceramic material and is generally rectangular being wider in one direction than the other, as can be seen in particular from FIG. 2 and also from FIGS. 1 and 3. The shape of this nozzle is such that the products of combustion fan out as they leave the outlet orifice 24 at the upper end of the nozzle 23.

An end cover 26 (FIGS. 1 and 2) has a central opening 27 therein, which, as seen in FIG. 2, is rounded at its ends.

In the vicinity of the lower portion of the nozzle 23, the inner wall 16 is provided with six equiangularly circumferentially spaced openings in the form of slots 25, the construction of which can be seen more readily from FIG. 4. In FIG. 4 the slots 25 are shown as punched out from the metal of the inner wall 16. They could, however, be formed by cutting holes in the wall 16 and providing an overlying deflector plate. The slots 25 are tangentially disposed in the same sense as the tangential disposition of the combustion air inlet 13, so that a proportion of the air which is blown in at 13 will be "scooped" by the slots 25 and projected onto the exterior surface of the nozzle 23 thus cooling it significantly, the air escaping between the shorter sides of the fish mouth 23 and the adjacent rounded ends of the opening 27. It has been found that heat conduction and radiation to the outer surfaces of the reactor are very significantly reduced so that the reactors may be expected to have a longer operational life and greater mechanical integrity than known reactors of this type.

Since thee inner shell 16A is supported in the manner indicated by the flange 17 and support ring 15, expansion of the reactor is readily accommodated so that the reactor is able to respond quickly to rapid changes in heat load and find particular application in regeneration heaters.

Figure 5:
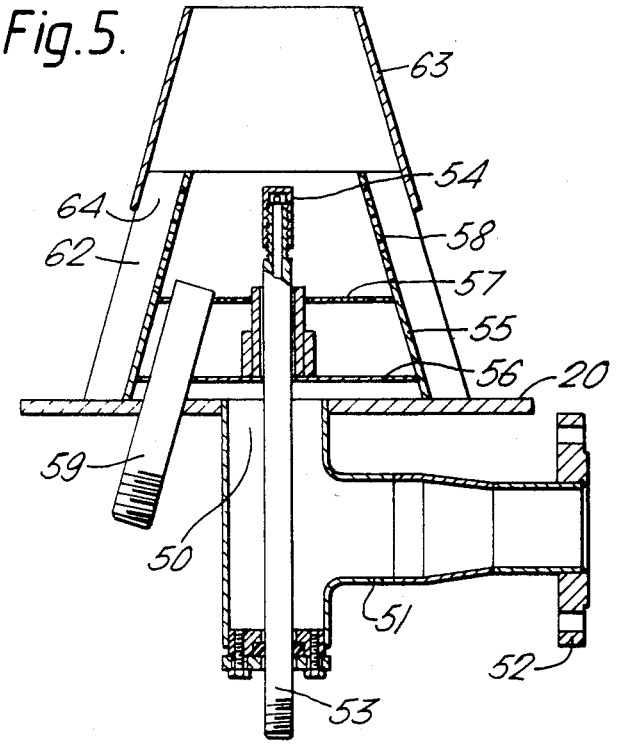
FIGS. 5 and 6 are an enlarged cross-section through, and a plan of, the base plate of the reactor of FIG. 1 with a fuel inlet assembly according to the present invention mounted thereon.
Figure 6:
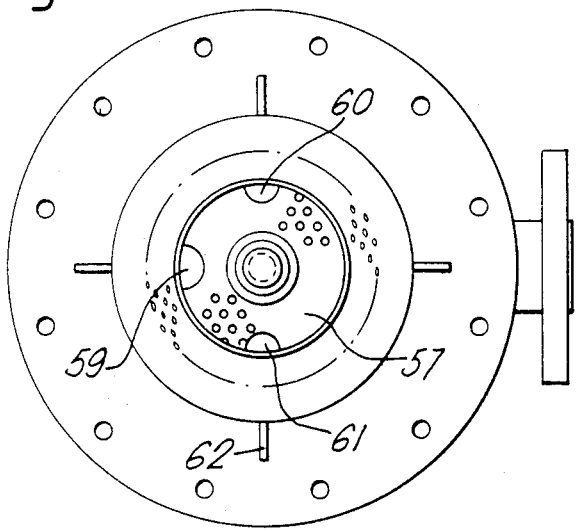

A preferred construction of the fuel inlet assembly is illustrated in more detail in FIG. 5. The base plate 20 is provided with a central fuel inlet opening 50 over which is fitted a T cross-section fuel inlet pipe 51 connectable, by flange 52, to a source of fuel. Extending along the cross of the T is the feed tube 53 of a pilot burner 54.

Mounted coaxially with the opening 50 is an inner cone 55 of upwardly convergent frusto-conical form, the lower edge of this cone 55 being secured to the base plate 20. Within the inner cone is a perforated support plate 56 which actually carries the pilot burner 54. About halfway along its length the inner cone is provided with a perforated flame arrestor plate 57.

While the lower portion of the cone 55 is of imperforate construction, the upper portion 58, above the arrestor plate 57 is itself perforated.

Angled along the line of inclination of the cone 55 and circumferentially spaced from one another, are an igniter, for example a spark igniter, 59, a flame rod 60 and a UV detector 61, the tips of these all extending above the flame arrestor plate 57.

Welded to the exterior wall of the inner cone 55 are four equi-angularly spaced vanes 62, the vanes 62 each extending in a radial plane with respect to the axis of the inner cone. Coaxially mounted with respect to the inner cone is an outer cone 63 which is welded to the vanes 62 and provides therewith an annular air space 64.

In operation, the pilot burner can be ignited, when gas is applied through the pipe 53 by means of the igniter 59. When the main gas supply is fed in through flange 52 and pipe 51, it passes through opening 50 and into a first inner cone and is ignited by the pilot flame. Combustion air for the pilot flame is provided by air flowing radially inwardly through the perforations in the upper portion 58 of the inner cone. Some combustion of air for the flame of the main burner is fed in via annular combustion air conduit provided by the the annular space 64 between the lower edge of a second outer cone and the upper edge of the lower or inner cone. This will only be a portion of the total amount of combustion air for the main burner, the remaining combustion air arriving in the space between the top edge of the outer cone 63 and the lower edge 19 of the inner shell 16A.

It will be appreciated that some premixing of the fuel gas can thus be achieved by the combustion air flowing in through the annular pre-mix combustion air conduit 64. This flow is oriented by the vanes 62 thus giving the air an axial component of velocity as it flows into the outer cone 63.

It has been found that this arrangement provides a very stable pilot and also good combustion characteristics. It has also been found that the noise generated by the reactor, under normal operating conditions, is relatively low, and is typically below 80 dB.

It is believed that the good combustion characteristics can be achieved because the flame is, in effect, held at the base of the inner shell 16A.

I claim:

1. In a fuel reactor comprising an inner shell mounted coaxially within an outer shell with an annular space therebetween, the outer shell having a closed end at one axial end of the reactor and the inner shell having at one end thereof a discharge nozzle extending through said closed end of the outer shell, a fuel inlet assembly mounted at the other end of said outer shell, the inner shell having an open end opposite to the end having the discharge nozzle, said open end being spaced axially from said fuel inlet assembly and said open end also being spaced radially from said outer shell to provide an opening from the annulus between the inner and outer shells, the outer shall having an inlet for blowing combustion air substantially tangentially into the annular space between the inner and outer shells and through the opening from the annular space to cause said combustion air to swirl axially from the annulus into the space within the outer shell between the open end of said inner shell and the other end of said outer shell, said fuel inlet assembly comprising, in combination:

A. a base plate mountable to close said other end of the outer shell;

B. a fuel inlet aperture in said base plate;

C. a first frusto-conical inlet cone mounted directly on said base plate to surround said fuel inlet aperture and with the wider end of the cone adjacent to the base plate;

D. a second frusto-conical inlet cone; and

E. a plurality of circumferentially spaced vanes extending between said first and second cones in substantially radial planes with respect to the axis of said first cone, said second cone being mounted coaxially with, spaced from and in partly overlapping relation to the first cone to provide an annular pre-mix combustion air conduit between said first and second cones, the wider end of the second cone facing the base plate and being axially spaced therefrom; the pre-mix combustion air conduit having an inlet opening at the wider end of the second cone for substantially axial, but convergent, flow of pre-mix combustion air into said conduit, the narrower ends of said first and second cones being spaced from one another to provide an opening from said conduit at the narrower end of said first cone, whereby a portion of the combustion air passes between said circumferentially spaced vanes to cause said portion of air to flow in an oriented axial direction substantially without swirl through said annular pre-mix combustion air conduit into the second cone for pre-mixing with the fuel entering the second cone and whereby the remainder of the combustion air mixes with the fuel on the side of said second cone remote from said plate, to provide fuel-air mixing needed for good combustion characteristics and relatively low noise levels.

2. A fuel inlet assembly as claimed in claim 1, and further comprising a pilot burner extending axially through the inlet aperture to a location within said first inlet cone.

3. A fuel inlet assembly as claimed in claim 2, wherein a portion of the first cone is perforated to allow some combustion air to enter the first inlet cone for the pilot burner.

4. A fuel inlet assembly as claimed in claim 2, and further comprising a flame arrester screen in said first cone positioned between the pilot burner and the fuel inlet aperture to prevent flame flashbacks from said pilot burner.

5. A fuel inlet assembly as claimed in claim 1, and further comprising a spark igniter in said first cone.

6. A fuel inlet assembly as claimed in claim 1, and further comprising a flame detector in said first cone.

* * * * *